United States Patent [19]

Ignacek

[11] Patent Number: 4,503,750

[45] Date of Patent: Mar. 12, 1985

[54] AMMUNITION MAGAZINE

[75] Inventor: James F. Ignacek, Placentia, Calif.

[73] Assignee: The United States of America as represented by the Secretary of the Army, Washington, D.C.

[21] Appl. No.: 456,940

[22] Filed: Jan. 10, 1983

[51] Int. Cl.[3] ..... F41D 10/26

[52] U.S. Cl. ..... 89/34

[58] Field of Search ..... 89/33 R, 33 D, 33 B, 89/33 BA, 33 BB, 33 BC, 33 C, 33 CA, 34, 35 R

[56] References Cited

U.S. PATENT DOCUMENTS

| | | | |
|---|---|---|---|
| 1,487,634 | 3/1924 | Waters | 89/33 BB |
| 2,400,385 | 5/1946 | Blaylock | 89/33 BB |
| 2,474,975 | 7/1949 | Goodhue | 89/34 X |
| 2,477,264 | 7/1949 | Pearson et al. | 89/33 BB |
| 3,169,445 | 2/1965 | Stanton et al. | 89/34 X |
| 3,427,923 | 2/1969 | Meyer et al. | 89/34 X |
| 3,498,178 | 3/1970 | Meyer et al. | 89/34 |
| 3,696,704 | 10/1972 | Backus et al. | 89/34 |
| 4,004,490 | 1/1977 | Dix et al. | 89/34 X |

FOREIGN PATENT DOCUMENTS

| | | | |
|---|---|---|---|
| 40871 | 12/1981 | European Pat. Off. | 89/33 BB |
| 2051355 | 4/1972 | Fed. Rep. of Germany | 89/34 |

*Primary Examiner*—David H. Brown
*Assistant Examiner*—John E. Griffiths, Jr.
*Attorney, Agent, or Firm*—Anthony T. Lane; Robert P. Gibson; Edward F. Costigan

[57] ABSTRACT

A magazine for storing and delivering ammunition has a housing and a plurality of pairs of rotating members. The housing has curved inboard and outboard walls. Each pair of the members includes an inboard and outboard one, rotatably mounted at the inboard and outboard wall, respectively, at diametrically opposed, interior positions. Also included is inboard and outboard endless carriers disposed on the inboard and outboard ones of the members, respectively, to circulate thereon. The magazine also includes a hand-off sprocket and a plurality of engage rods, the latter being mounted across the carriers and spaced to allow the ammunition to fit therebetween. The hand-off sprocket is mounted alongside the carriers, for removing passing ones of the ammunition.

6 Claims, 8 Drawing Figures

FIG. 5
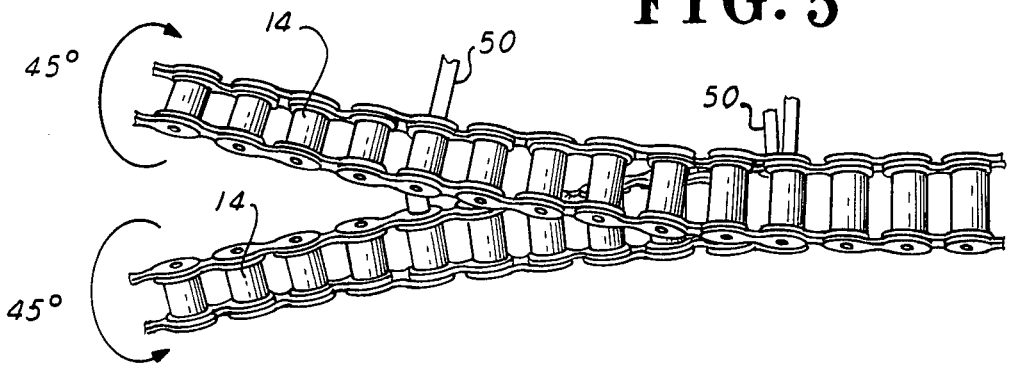
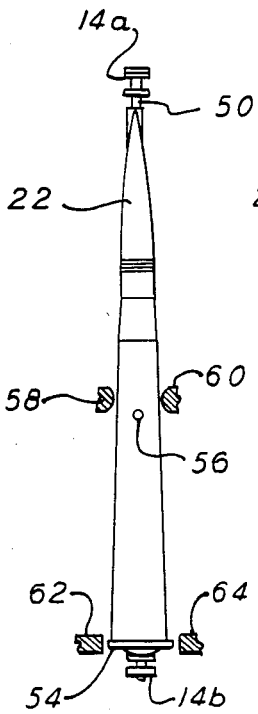
FIG. 6A
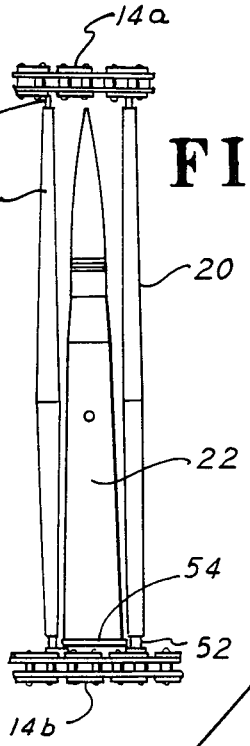
FIG. 6B
FIG. 7
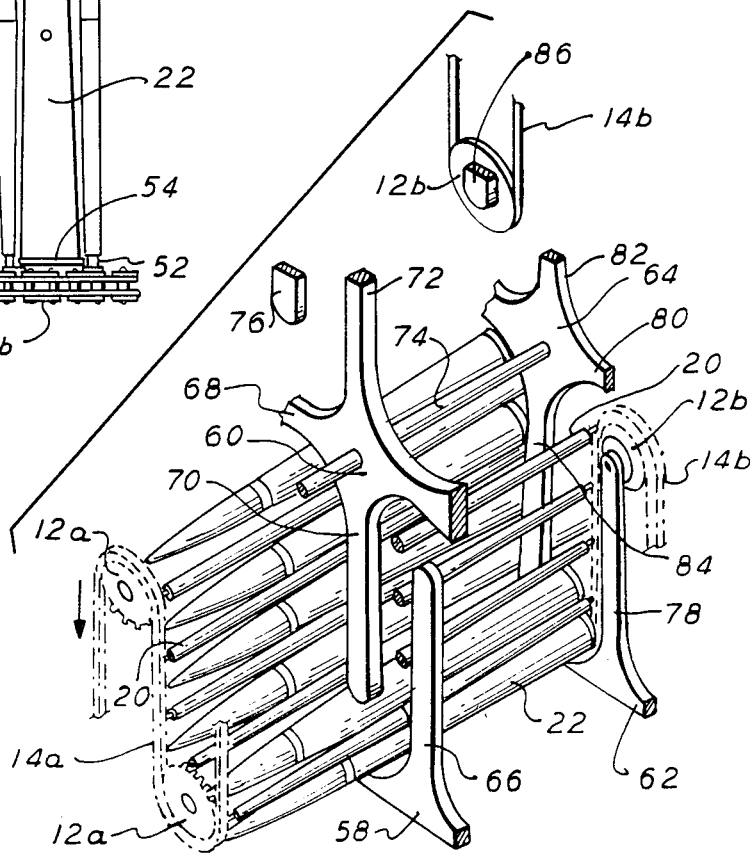

AMMUNITION MAGAZINE

GOVERNMENT INTEREST

The invention described herein was made in the course of a contract with the Government.

BACKGROUND OF THE INVENTION

The present invention relates to ammunition magazines and, in particular, to magazines which carry rounds along a serpentine path before delivering them to a weapon.

Certain weapons, including turret mounted guns, require a magazine for storing and rapidly delivering rounds of ammunition. It is desirable to mount such magazines on a gun turret to rotate therewith. Since the magazine is mobile, it should be compact.

Known magazines have employed a box-like housing through which the rounds of ammunition travel on a serpentine path. These known magazines employ a complicated mechanism using rods, shafts, gears and pushers to rapidly convey the ammunition, sliding them on a plate to be picked up by an elevator.

Accordingly, there is a need for a compact and efficient magazine for rapidly supplying rounds to a weapon.

SUMMARY OF THE INVENTION

In accordance with the illustrative embodiment demonstrating features and advantages of the present invention, there is provided a magazine for storing and delivering ammunition. The magazine has a plurality of pairs of rotating members and a housing, the latter comprising curved inboard and outboard walls. Each pair of the rotating members includes an inboard and outboard one, rotatably mounted at the inboard and outboard wall, respectively, at diametrically opposed, interior positions. The magazine also includes inboard and outboard endless carriers disposed on the inboard and outboard ones of the members, respectively, to circulate thereon. Also included is a plurality of engage means mounted across the carriers, and spaced to allow the ammunition to fit therebetween. The magazine also has a hand-off means mounted alongside the carriers for removing passing ones of the ammunition.

By employing the foregoing apparatus a compact and efficient ammunition magazine is provided. In the preferred embodiment, a pair of endless chains pass along separate concentric cylindrical surfaces inside a housing. The chains travel on sprockets and follow a serpentine path that generally progresses circumferentially as it takes repeating transverse excursions. Pusher rods span the endless chains and are spaced to fit rounds of ammunition therebetween.

The rounds of ammunition are urged by the pusher-rods through a maze formed by a set of ribs on a spine-line guide. These ribs interdigitate to form the transverse excursions of a serpentine path. Some of the guides are preferably located adjacent to the center of gravity of the rounds of ammunition so they are readily conveyed without a tendency to rotate or jam.

The chains and guides are arranged in the preferred housing so that the rounds of ammunition remain radially aligned and spaced from its neighbors by an acute angle. Preferably, two complementary housings are used each of which encompass less than 180° around a gun turret. The inboard walls of each housing define a central opening encircling the axis of the turret.

The pusher rods can each have a groove at their outboard end for engaging the rear rim of each round of ammunition and thereby preventing longitudinal translation of the round.

The endless chain may be routed past a hand-off sprocket which can remove rounds from the chain and deliver them to an elevating means.

BRIEF DESCRIPTION OF THE DRAWINGS

The above brief description as well as other objects, features and advantages of the present invention will be more fully appreciated by reference to the following detailed description of a presently preferred but nonetheless illustrative embodiment in accordance with the present invention when taken in conjunction with the accompanying drawings wherein:

FIG. 5 is a front view of the chains of FIG. 1 showing their ability to twist axially;

FIGS. 6A and 6B are orthogonal side views of the ammunition contained between the chains of the magazine of FIG. 1; and FIG. 7 is a detailed perspective view of a portion of the interior components of the magazine of FIG. 1.

DETAILED DESCRIPTION OF THE PREFERRED EMBODIMENT

Figure 1:
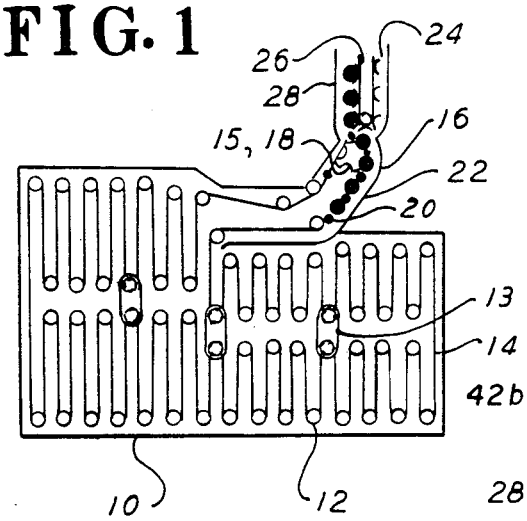
FIG. 1 is a schematic diagram showing the serpentine path of a magazine according to the principles of the present invention.

Referring to FIG. 1, an ammunition magazine employs a housing 10. Housing 10 may be considered a schematic development of the arrangement of circumferentially disposed components within housing 10. In particular, rotatably mounted within housing 10 is a plurality of pairs of rotating members, shown herein as pairs of gears 12. Several adjacent gears 12 are linked by small chain loops 13. Routed over gears 12 are inboard and outboard endless carriers, in the form of parallel chains 14. Chains 14 circulate along the curved walls of housing 10 in a generally clockwise manner (with respect to the plane of this view and not the axis of the housing) but taking transverse excursions over gears 12. Housing 10 has an upwardly extending conduit 16 containing a sprocket 18 mounted in the upper end of the conduit to rotate clockwise. Chains 14 make an excursion through conduit 16, turning over gears 15 (hidden from view) mounted coaxially with sprocket 18. Within conduit 16, several engage means are illustrated herein as elements 20, it being understood that they are evenly distributed along the entire length of chains 14. As explained in further detail hereinafter, engage means 20 are a series of parallel, spaced pusher rods mounted between chains 14 with a spacing sufficient to embrace rounds 22. When housing 10 is fully loaded, the length of chain 14 within housing 10 is filled with an alternating series of pusher rods 20 and rounds 22. Sprocket 18 feeds ammunition to buckets 24 which are mounted on the outer surface of conveyor belt 26. Rounds 22 can be lifted upwardly by sprocket 18 and into one of the buckets 24 for transport through elevator conduit 28.

Figure 2:
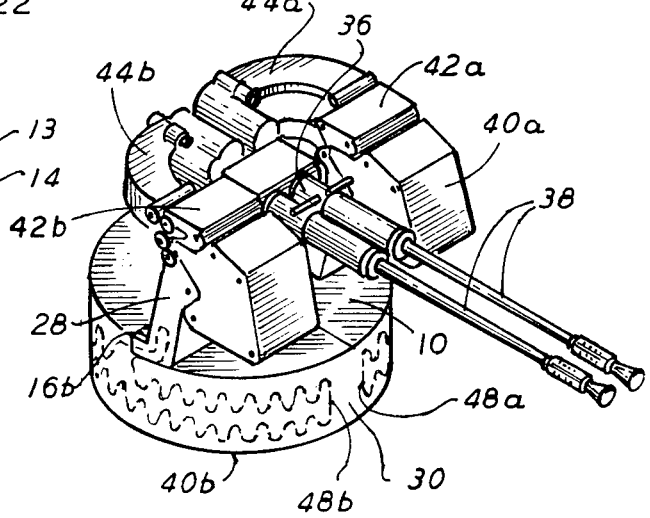
FIG. 2 is a perspective view of a gun turret employing the magazine of FIG. 1.
Figure 3:
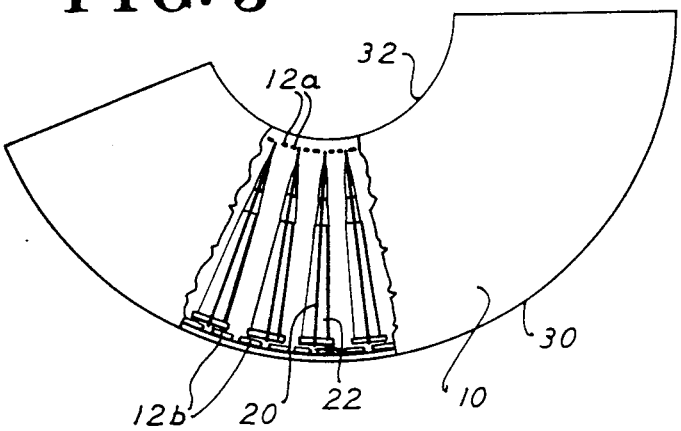
FIG. 3 is a plan view of one of the magazines of FIG. 2 having an upper surface broken away to reveal interior components.
Figure 4:
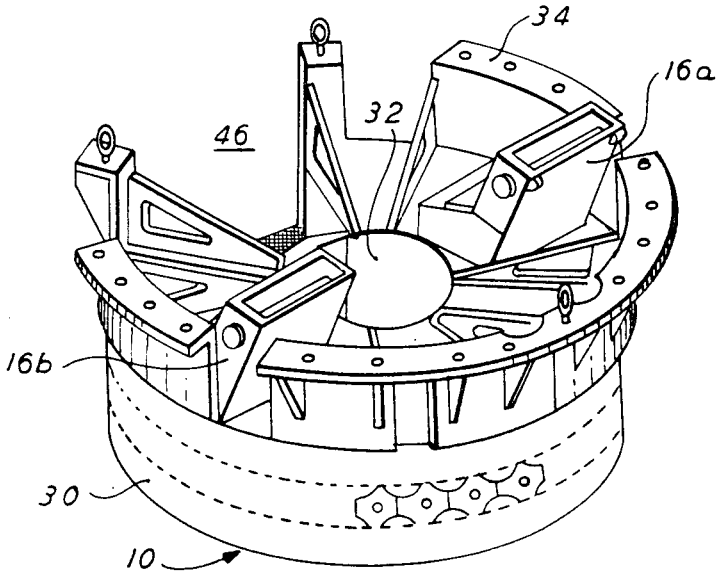
FIG. 4 is a perspective view of the magazines of FIG. 2 removed from the gun turret.

Referring to FIGS. 2, 3, and 4, housing 10 is shown having generally a truncated cylindrical shape and employing a curved outboard wall 30 and a concentric, curved inboard wall 32. As shown in FIG. 4, the magazine can include an upwardly extending flanged bracket 34 which is used to mount the magazine to the turret 36 (FIG. 2). As shown in FIG. 2, magazine 10 is mounted below gun turret 36, to rotate therewith. Turret 36 includes a pair of gun barrels 38 and a pair of upper magazines 40*a* and 40*b* that feed through a pair of articulating feeders 42*a* and 42*b* to fan-type feeders 44*a* and 44*b*. In this embodiment, magazine housing 10 is partitioned into two housings each encompassing approximately 150°. The remaining 60° provides clearance, shown as opening 46 (FIG. 4). In FIGS. 2 and 3, ammunition 22 is shown distributed at angularly spaced, radially aligned positions along serpentine paths 48*a* and 48*b*. Each of these paths has an upper and lower track, each track generally following a circumferential path of travel with repeating transverse excursions. The paths 48*a* and 48*b* generally circulate clockwise as defined previously in connection with FIG. 1, making an excursion through conduits 16*a* and 16*b*, respectively (FIG. 4). (The conduits 16*a* and 16*b* were collectively defined in FIG. 1 as item 16).

As illustrated in FIG. 3, gears 12 alternate between upper and lower gears 12*a* and 12*b*. Angularly separated gears are located in slightly different planes so that a chain transferring between gears must twist somewhat.

Referring to FIG. 5, chains 14 are shown as conventional circular or flex roller chains having the ability to twist 45° axially, that is, along a length of chain in a transverse excursion of the previously mentioned serpentine path. Of course, other degrees of freedom are possible. Roller chain 14 has in one embodiment a 15 inch bow radius and is shown having pin extensions 50 which connect to pusher rods described hereinafter.

Referring to FIGS. 6A and 6B, ammunition 22 is shown positioned perpendicularly between chains 14, separately shown as inboard chain 14*a* and outboard chain 14*b*. Rods 20 are shown as having ends that taper and connect to chains 14 through roller pin extensions of the chain, such as pin extension 50. Rods 20 have at their outboard ends adjacent to the outboard wall (wall 30 of FIG. 3) annular grooves 52. Grooves 52 are sized to engage rear rim 54 of round 22 and prevent its longitudinal shifting. Mounted proximate to the center of gravity 56 of round 22 are a pair of central guides 58 and 60, which act to prevent transverse shifting of round 22. Also arranged to prevent transverse shifting are guides 62 and 64 which embrace rear rim 54 on opposite sides of chain 14*b*.

Referring to FIG. 7, previously illustrated guide 58 and 60 as shown herein as first central frame 58 and second central frame 60. Frame 58 is a comb-like structure having a plurality of upright ribs 66, only one such rib being illustrated herein, the balance of the frame structure being broken away for clarity. Second frame 60 is also a comb-like structure having a transverse spine 68 from which project a first plurality of lower ribs 70 and a second plurality of upper ribs 72. Frame 58 is mounted on the floor of the housing (housing 10 of FIG. 4) while frame 60 is supported on bracket 74 which is radially supported between the inner and outer walls (walls 30 and 32 of FIG. 4). Ribs 66 and 70 interdigitate to form the serpentine path previously illustrated. Frame 76, an inverted analog to frame 58, is mounted above guide 60 and has teeth which interdigitate with ribs 72 to form another serpentine path similar to that of existing ribs 70 and 66. Only a portion of upper frame 76 is illustrated herein for clarity.

Ammunition 22 is shown mounted in parallel along the serpentine path between guides 58 and 60. Ammunition 22 alternates with pusher rods 20, which are mounted between inboard chain 14*a* and outboard chain 14*b*. Inboard chain 14*a* is shown circulating around gears 12*a* which are rotatably mounted on the inboard wall (wall 32 of FIG. 3). Outboard chain 14*b* is shown circulating on gears 12*b*.

Comb-like frame 62, referred to herein as a first guide, has a plurality of spaced, parallel, upright teeth 78. Mounted at the upper end of each of the teeth 78 is outboard gear 12*b* which carries outboard chain 14*b*. Supported on bracket 74 is a second guide 64 comprising spine 80 supporting upwardly extending teeth 82 and downwardly extending teeth 84. Teeth 82 and 84 interdigitate with elements 86 and 78, respectively, to form a serpentine path through which ammunition 22 can circulate. Upper guide 86, shown only in part for clarity, has an inverted shape similar to that of guide 62. In addition, the tips of the teeth of guide 86 support outboard sprockets 12*b* over which outboard chain 14*b* turns. Again the interspace between guide 86 and 64 forms a serpentine path through which ammunition 22 travels.

In order to facilitate an understanding of the principles associated with the foregoing equipment, its operation will be briefly described. It will be initially assumed that the spaces between pusher rods 20 located within housing 10 each contain a round of ammunition 22. Chains 14 are driven by rotating sprockets 15 and 18 (FIG. 1). Accordingly, sprocket 15 circulates chain 14 clockwise within housing 10. Loops 13 tend to evenly distribute the chain tension within housing 10 by providing a shortened drive path. Accordingly, ammunition 22 travels between guides 58, 60 and 76 as shown in FIG. 7. Similarly, rims 54 of ammunition 22 travel along guides 62, 64 and 86 and are held axially by means of grooves 52 (FIG. 6B) in rods 20. The rounds 22 located in conduit 16*b* are urged by pusher rods 20 between the spokes of sprocket 18. Once engaged in this fashion, sprocket 18 lifts round 22 into a passing bucket 24 on conveyor 26. Once loaded in this fashion, rounds 22 are lifted through elevator 28. Rounds 22 reaching the upper end of elevator 28 are conveyed into the input end of fan assembly 44*b* (FIG. 2) with their rear rims facing outboard. Fan 44*b* then rotates the round so that its rear rim faces aft thereby preparing it for loading into gun 36 to be fired through barrel 38. The foregoing described operation through one half of the lower magazine, it being understood the other half operates similarly.

It is to be appreciated that various modifications may be implemented with respect to the above described preferred embodiment. For example, the length, configuration and direction of the chain path within the magazine can be altered depending upon magazine size and the number of rounds stored. In addition, while a hand-off sprocket and coaxial chain sprocket is shown as the point of drive, in other embodiments the drive can be applied at different positions. Also, in some embodiments, certain chain idler sprockets may be eliminated or others included depending on the application. Also while an elevator and fanned loading assembly is shown herein, in some embodiments the foregoing may be eliminated or modified. Additionally, the various dimensions and materials described herein may be altered depending upon the associated ammunition caliber, length, speed of operation, weight, space available, accuracy, etc.

Obviously, many modifications and variations of the present invention are possible in light of the above teachings. It is therefore to be understood that within the scope of the appended claims, the invention may be practiced otherwise than as specifically described.

What is claimed is:

1. A curved magazine for storing and delivering linkless rounds of ammunition comprising:

a curved housing having a curved inboard wall, a curved outboard wall, and a floor, a plurality of first guides, one of said first guides mounted on said floor adjacent said curved outboard wall, another of said first guides mounted adjacent said curved outboard wall and on a bracket support between said curved inboard wall and said curved outboard wall, a plurality of rotatable gears, in pairs, one gear of which is operatively mounted on one of said first guides and the other one of which is operatively mounted on said curved inboard wall, a pair of endless flexible chain carriers, one of which is disposed on said gears along said curved inboard wall and the other of which is disposed on said gears on said first guides, said endless chain carriers following a serpentine path, a portion of which progresses circumferentially with repeating transverse excursions, a plurality of pusher rods each of which is mounted in spaced relation between said endless chain carriers, said pusher rods aligned radially relative to said curved inboard and outboard walls, a plurality of rounds of ammunition each of which is disposed between adjacent ones of said pusher rods, said pusher rods imparting movement to said rounds, a plurality of central guides mounted between said curved walls and positioned adjacent the center of gravity of said rounds, said central guides preventing movement of said rounds transverse said endless chain carriers, a hand-off sprocket mounted adjacent said endless chain carrier to remove each of said rounds from said endless chain carrier, an upwardly extending elevating conduit mounted adjacent said hand-off sprocket having buckets for the operative receipt of said rounds from said hand-off sprocket.

2. The magazine of claim 1 wherein said central guides consist of a first and second interdigitated comb-like frame having between them a serpentine interspace.

3. The magazine of claim 1 wherein each said round is provided with a rear rim, and said pusher rods each have an outboard end provided with a groove sized to engage said rear rims of the adjacent rounds to prevent longitudinal translation of said adjacent rounds.

4. The magazine of claim 3 wherein said first guides define between them a serpentine interspace, each of said first guides positioned in spaced relation at the radial position adjacent said groove of each of said rods.

5. The magazine of claim 4 wherein said first guide mounted on said floor has a plurality of spaced teeth provided with an extreme end portion upon which said gears are mounted.

6. The magazine of claim 5 wherein said first guide mounted on the bracket is provided with a plurality of ribs projecting into the space between said teeth of said first guide mounted on the floor defining a serpentine interspace.

* * * * *